US005094017A

United States Patent [19]

Matsumoto et al.

[11] Patent Number: 5,094,017

[45] Date of Patent: Mar. 10, 1992

[54] DIRECT DRIVEN TYPE SHOCK RIPPER DEVICE

[75] Inventors: Norihisa Matsumoto, Hirakata; Masao Murakami, Komatsu, both of Japan

[73] Assignee: Kabushiki Kaisha Komatsu Seisakusho, Japan

[21] Appl. No.: 476,506

[22] PCT Filed: Sep. 28, 1989

[86] PCT No.: PCT/JP89/00987

§ 371 Date: Jul. 25, 1990

§ 102(e) Date: Jul. 25, 1990

[87] PCT Pub. No.: WO90/03473

PCT Pub. Date: May 4, 1990

[30] Foreign Application Priority Data

Sep. 30, 1988 [JP] Japan ..... 63-128698[U]

[51] Int. Cl.[5] ..... E02F 5/02

[52] U.S. Cl. ..... 37/2 R; 37/195; 37/DIG. 1; 37/117.5; 37/98; 172/260.5

[58] Field of Search ..... 37/80 R, 98, 103, 118 R, 37/195, 183 A, DIG. 1, 2 R, 117.5; 171/7; 172/12, 260.5, 237, 529

[56] References Cited

U.S. PATENT DOCUMENTS

| | | | |
|---|---|---|---|
| 2,348,796 | 5/1944 | Ferwerda et al. | 37/80 R X |
| 2,982,034 | 5/1961 | Perry et al. | 37/98 |
| 3,539,018 | 11/1970 | Sprenkel | 172/260.5 X |
| 4,031,964 | 6/1977 | Takahashi et al. | 172/12 X |
| 4,229,046 | 10/1980 | Gurries | 37/DIG. 18 X |
| 4,240,216 | 12/1980 | Martel | 37/98 |
| 4,249,614 | 2/1981 | van der Lely | 172/260.5 |
| 4,277,899 | 7/1981 | Güthoff | 37/103 |
| 4,453,772 | 6/1984 | Roussin | 37/DIG. 18 X |
| 4,625,438 | 12/1986 | Mozer | 37/103 X |
| 4,834,461 | 5/1989 | Fidler et al. | 37/DIG. 18 X |

FOREIGN PATENT DOCUMENTS

| | | |
|---|---|---|
| 52-47284 | 10/1977 | Japan . |
| 61-112066 | 7/1986 | Japan . |
| 62-35068 | 3/1987 | Japan . |
| 64-47859 | 3/1989 | Japan . |

*Primary Examiner*—Dennis L. Taylor
*Assistant Examiner*—J. Russell McBee
*Attorney, Agent, or Firm*—Richards, Medlock & Andrews

[57] ABSTRACT

A direct driven shock ripper device according to the present invention is capable of efficiently transferring blows of a hydraulic breaker (10) to a base rock. It includes a bracket (2) which can be affixed to the rear end of a construction machine vehicle, a beam (4) on which a shank (8) and a breaker mount bracket (9) supporting the hydraulic breaker (10) are mounted, the beam (4) being disposed to the rear of the bracket (2), an arm (6) which couples a lower portion of the bracket (2) to a lower portion of the beam (4), a tilt cylinder (5) which couples an upper portion of the bracket (2) to an upper portion of the beam (4), and a lift cylinder (16) which couples an upper portion of the bracket (2) to a lower portion of the beam (4). A pair of link members (7) are provided between the beam (4) and the shank (8) to pivotally support the shank (8) on the beam (4) and thereby form a quadric linkage. The quadric linkage efficiently transfer a force to the base rock in the form of a linear motion of the shank (8). In consequence, the hard rock ripping limit increases, and ripping operability increases.

4 Claims, 6 Drawing Sheets

FIG. 5
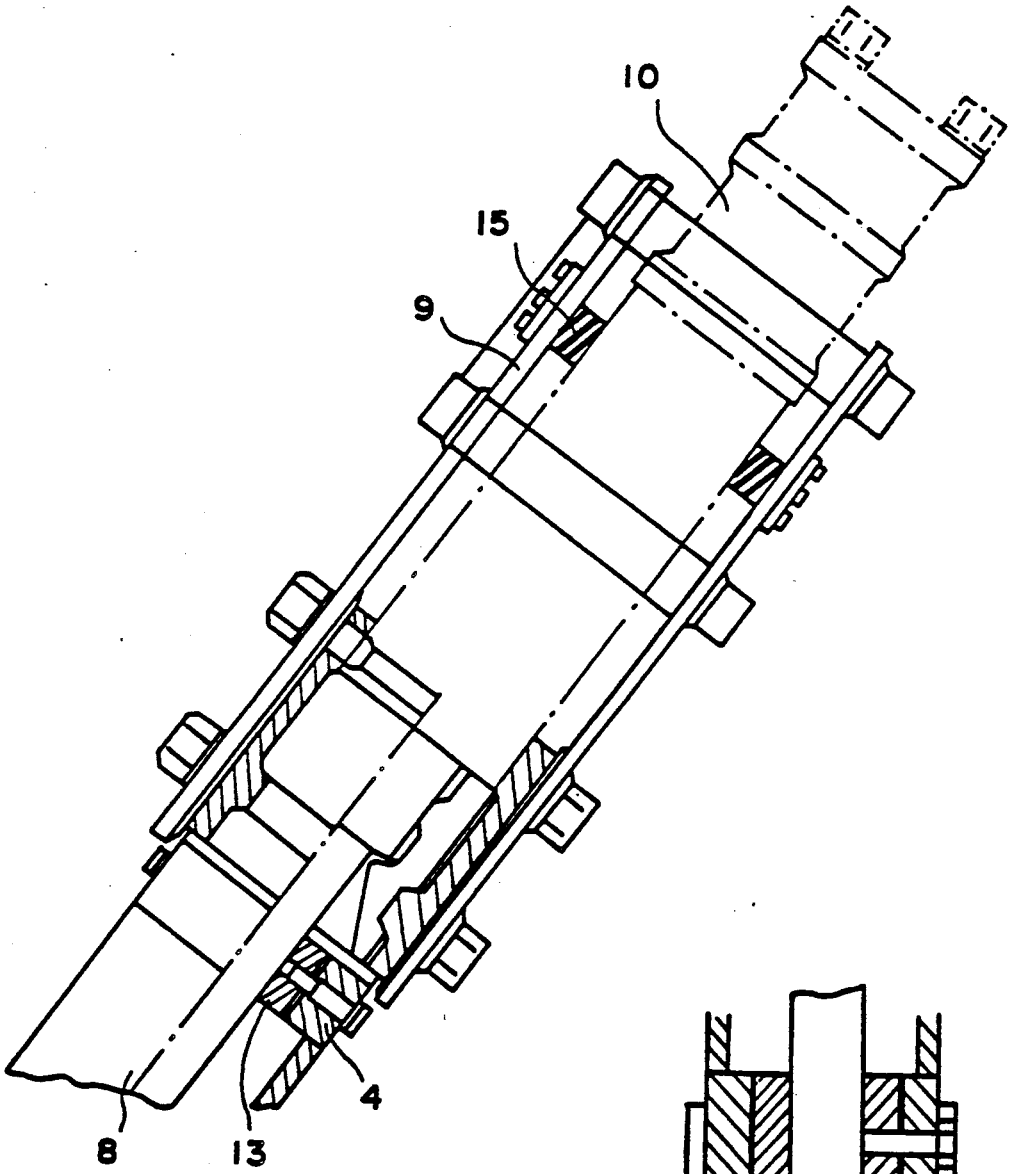
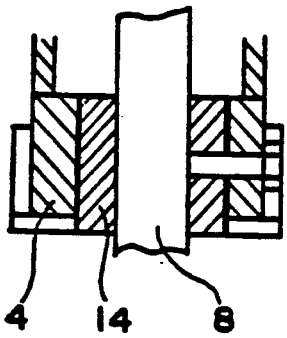
FIG. 6

DIRECT DRIVEN TYPE SHOCK RIPPER DEVICE

TECHNICAL FIELD

The present invention relates to a parallel linkage type shock ripper device, and more particularly, to a direct driven shock ripper device which enables blows of a hydraulic breaker to be efficiently transferred to a base rock.

BACKGROUND ART

Conventionally, when base rocks are to be dug (ripping operation) by a construction machine such as a bulldozer, a parallel link type shock ripper device 1 is mounted on a rear 2 of the vehicle, as shown in FIG. 7. A shank 8 is forced into the base rock by the depressing force generated by the weight of the bulldozer. The base rock is broken up by utilizing the towing force of the bulldozer and the hydraulic force of a tilt cylinder 5. The ability with which the bulldozer breaks up the base rock is substantially proportional to the weight of the vehicle. Thus, the hardness of the base rocks at the operation site is investigated beforehand, and a vehicle which suits the operation condition is selected.

When hard rocks that cannot be broken up by such an operation exist, they are cracked by utilizing the blows of a hydraulic breaker 10 mounted on the ripper device 1 to facilitate breaking (as is disclosed in Japanese Utility Model Laid-Open No. 35068/1987). The blows F given by the hydraulic breaker 10 are transferred from an impact receiving surface **8*b* of the shank 8 to the base rock through a ripper point 17 provided at one end of the shank 8, as shown in FIG. 8. However, since a shank rotating shaft 8*a* provided at the other end of the shank 8 is pivotally supported on an arm 6, the ripper point 17 revolves in the form of an arc around the shank rotating shaft 8*a*. In consequence, the blow F exerted on the base rock is reduced, and the function of the hydraulic breaker 10 cannot be fully utilized. As a result, the base rock cannot be broken regularly, and the vehicle jolts considerably when it travels in reverse, providing an uncomfortable ride. Furthermore, since the ripper point 17 cannot be forced very far into the rock, the ripper point 17** slips often, increasing wear of the ripper point. Also, the tracked vehicles slip often, increasing wear or damage thereof.

In view of the aforementioned problem, an object of the present invention is to provide a direct driven shock ripper device which is capable of efficiently transferring blows of a hydraulic breaker to a base rock.

SUMMARY OF INVENTION

To this end, the present invention provides a direct driven type shock ripper device which includes a bracket which can be affixed to the rear of a construction machine vehicle, a beam on which a shank and a hydraulic breaker, which gives impacts to the shank, are mounted, the beam being disposed to the back of the bracket; an arm which interconnects a lower portion of the bracket to a lower portion of the beam; a tilt cylinder which interconnects an upper portion of the bracket to an upper portion of the beam; the bracket, the beam, the arm and the tilt cylinder in combination forming a parallel linkage; and a lift cylinder provided between an upper portion of the bracket and a lower portion of the beam. The shank is mounted on the beam through a pair of link members to form a quadric linkage. In consequence, blows of the hydraulic breaker can be efficiently transferred to a base rock in the form of a linear motion of the shank. This facilitates breaking or cracking of the base rock and improves the ripping operability.

BRIEF DESCRIPTION OF DRAWINGS

FIGS. 5 and 6 are respectively sections taken along the lines 5—5 and 6—6 of FIG. 1;

BEST MODE FOR CARRYING OUT THE INVENTION

Figure 1:
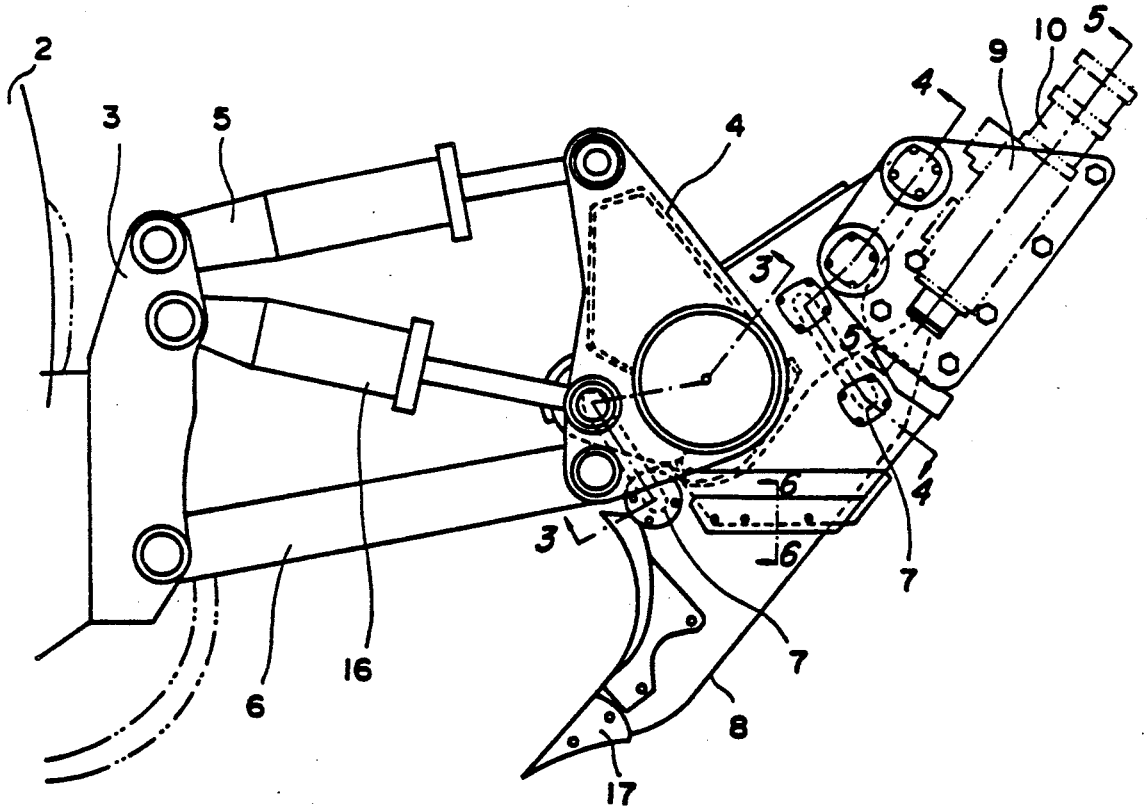
FIG. 1 is a side elevational view of an embodiment of a direct operated shock ripper device according to the present invention.

FIG. 1 is a side elevational view of an embodiment of a direct driven shock ripper device according to the present invention. This direct driven shock ripper device includes a support bracket 3 fixed to the rear end 2 of a vehicle, and a beam 4 disposed to the rear of the bracket 3, an arm 6 which couples a lower portion of the bracket 3 and a lower portion of the beam 4, a tilt cylinder 5 which interconnects an upper portion of the bracket 3 to an upper portion of the beam 4, and a lift cylinder 16 extending between an upper portion of the bracket 3 and a lower portion of the beam 4. A shank 8 is mounted on the beam 4, and a hydraulic breaker 10 is supported on the beam 4. The shank 8 is pivotally supported on the beam 4 through a pair of link members 7. A ripper point 17 is mounted on the forward end of the shank 8. An impact receiving surface **8*a* is provided on the rear end of the shank 8. The hydraulic breaker 10 is held above surface 8*a* by a breaker mount bracket 9 mounted on the beam 4**.

Figure 2:
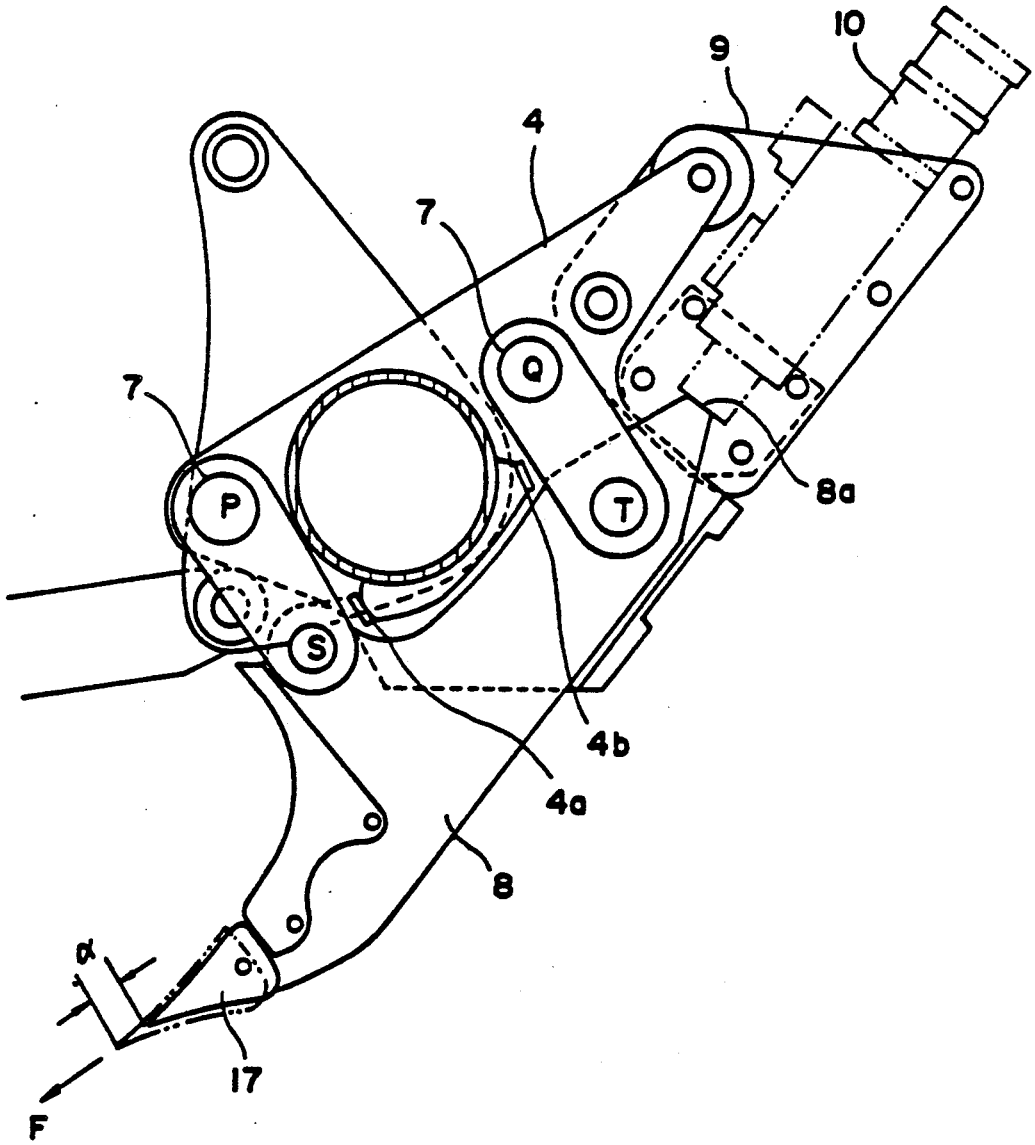
FIG. 2 is a cross-sectional view showing a state in which a ripper shank is mounted on a beam.

FIG. 2 is a cross-sectional view showing a state in which the shank 8 is pivotally supported on the beam 4 by means of the pair of link members 7. Each of the links 7 is pivotally supported on the beam 4 at one end thereof P or Q. The other ends S and T of the links 7 are supported on the shank 8. The four points, P, Q, S and T form a quadric linkage which moves the shank 8 in a straight line when the hydraulic breaker 10 strikes the shank 8. Link member stoppers **4*a* and 4*b* are mounted on the beam 4 to limit the linear motion of the shank 8 which occurs when loads are applied to the shank 8**.

Figure 3:
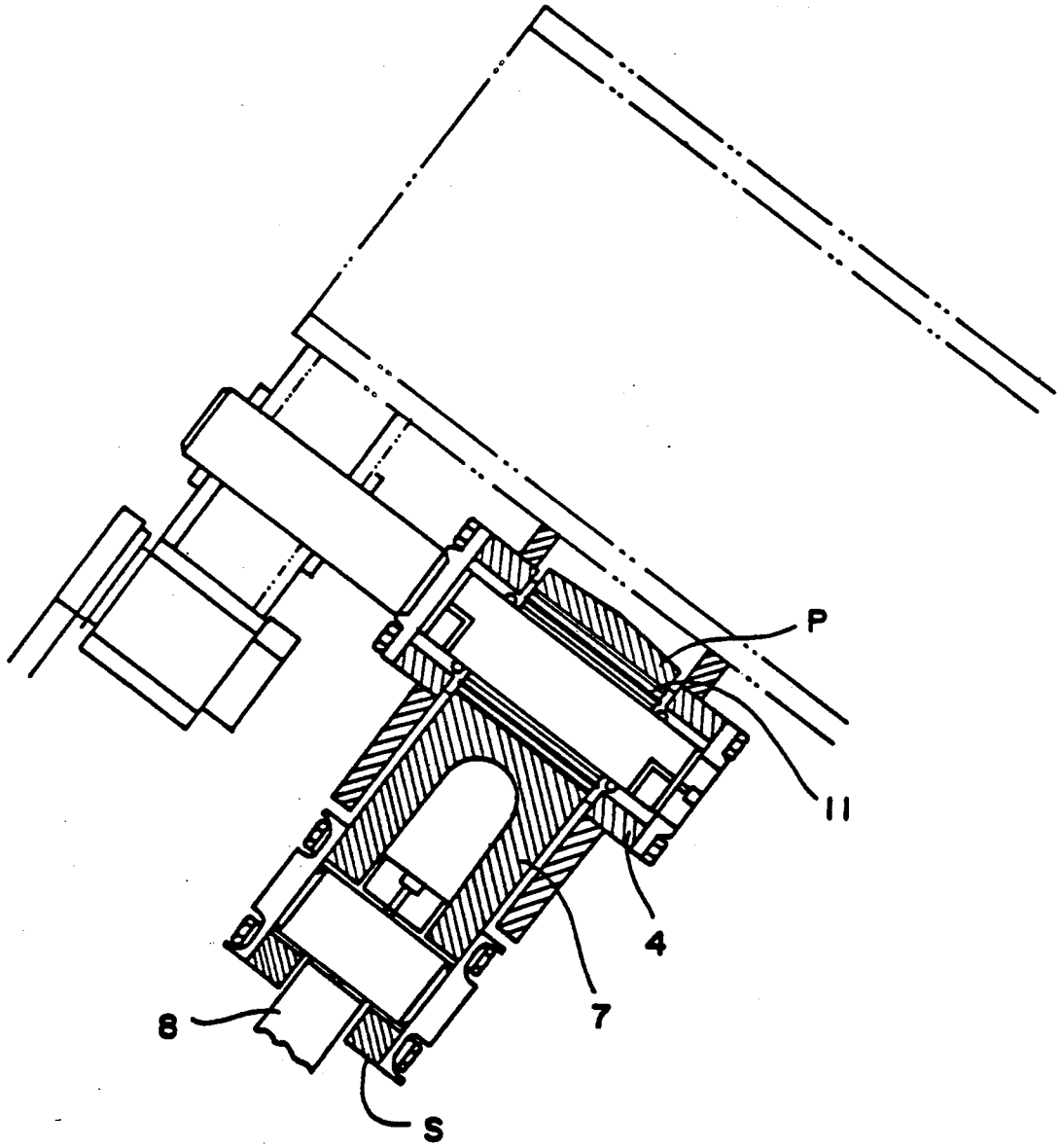
FIG. 3 is a section taken along the line 3—3 of FIG. 1.

FIG. 3 is a section taken along the line 3—3 of FIG. 1. The one end P of the link 7 is pivotally supported on the beam 4 through an elastic bushing 11, and the other end S is pivotally supported on the shank 8.

Figure 4:
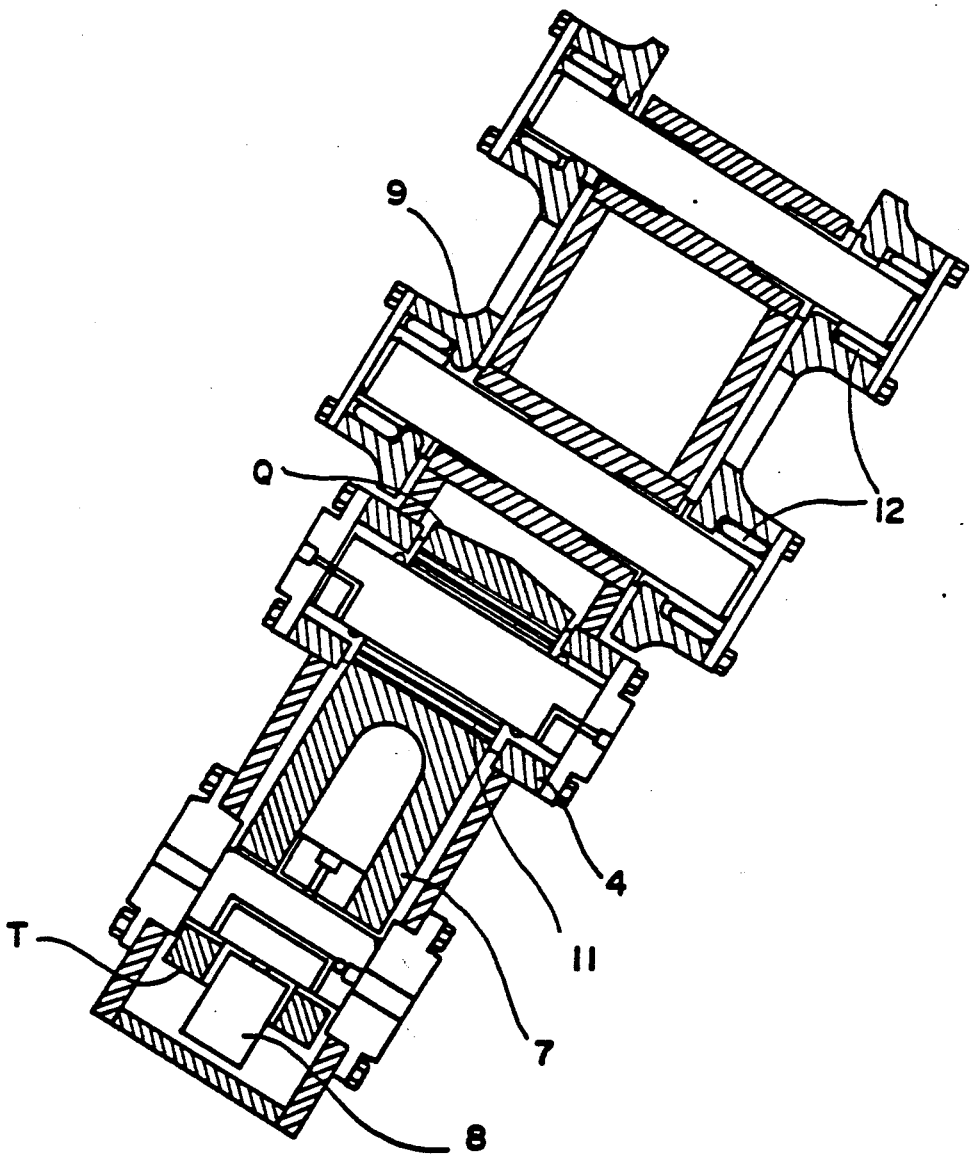
FIG. 4 is a section taken along the line 4—4 of FIG. 1.
Figure 7:
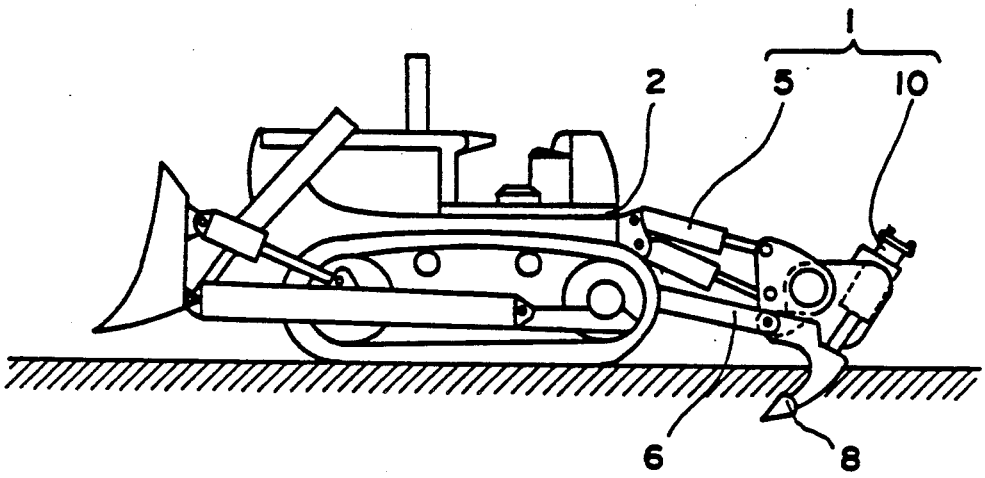
FIG. 7 (PRIOR ART)
FIG. 7 is a side view of a bulldozer with a conventional shock ripper device.
Figure 8:
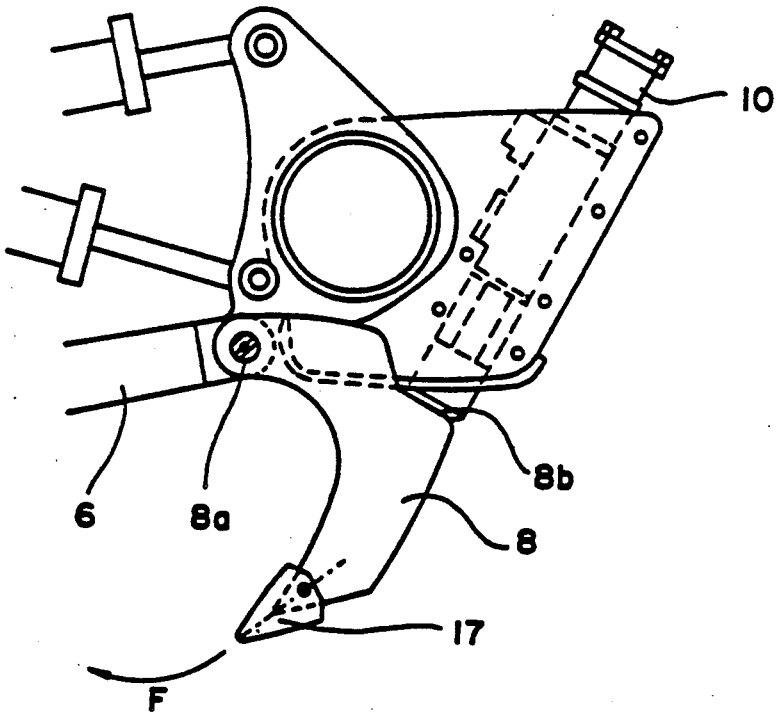
FIG. 8 (PRIOR ART)
FIG. 8 illustrates the conventional shock ripper device.

FIG. 4 is a section taken along the line 4—4 of FIG. 1. The one end Q of the link 7 is pivotally supported on the beam 4 through the elastic bushing 11, and the other end T is pivotally supported on the shank 8. The breaker mount bracket 9 is pivotally supported on the beam 4 through an elastic bushing 12.

FIGS. 5 and 6 are respectively sections taken along the lines 5—5 and 6—6 of FIG. 1. An upper side stopper 13 and a lower side stopper 14 are mounted on the inner side of the beam 4 in such a manner that they grip the shank 8 to receive the lateral deflection generated in the shank 8 when the vehicle is swivelled. An elastic bushing 15 is mounted on the inner side of the breaker mount bracket 9 to prevent lateral deflection generated in the hydraulic breaker 10 when it strikes the shank 8.

When the bulldozer with the thus-arranged direct driven shock ripper device is operated for a normal ripping operation, the piston of the lift cylinder 16 is extended, as shown in FIG. 1. Thereafter, the shank 8 is forced into the ground by the depressing force caused by the weight of the vehicle, and the base rock is broken up by utilizing the pulling force of the vehicle and the pulling up force of the tilt cylinder 5. The pulling force, depressing force and pulling up force are received by the pair of link member stoppers 4*a* and 4*b* mounted on the beam 4. The lateral force generated when the vehicle is swivelled is received by the upper and lower side stoppers 13 and 14 mounted on the inner side of the beam 4. When there exists a base rock that cannot be broken by the normal ripping operation, a blow is given to the impact receiving surface 8*a* of the shank 8 by the hydraulic breaker 10. At that time, since the shank 8 is pivotally supported on the beam 4 by means of the pair of link members 7, as shown in FIG. 2, the shank 8 moves in a straight line (in directions indicated by the arrows), allowing the impact force to be efficiently transferred to the base rock through the ripper point 17 mounted on the forward end of the shank 8. Thus, the hard rock ripping limit (elastic wave speed) increases, and ripping operability therefore increases. The vibrations generated in the hydraulic breaker 10 and the shank 8 at this time are alleviated by the elastic bushings 12 and 11 respectively mounted on the breaker mount bracket 9 and the links 7. The transverse deflection caused by the vibrations of the hydraulic breaker 10 are absorbed by the transverse deflection preventing elastic bushing 15 mounted on the breaker mount bracket 9.

Industrial Applicability

As will be understood from the foregoing description, in the direct driven shock ripper device according to the present invention, it is possible to improve the hard rock ripping limit and thus increase the ripping operability. It is also possible to provide a comfortable ride and prolong the life of the ripper point on tracked vehicles.

What is claimed is:

1. In a direct driven type shock ripper device including a support bracket which can be affixed to the rear end of a construction machine vehicle, a beam disposed to the rear of said support bracket, a shank and a breaker mount bracket mounted on said beam, a hydraulic breaker supported on said breaker mount bracket, an arm which couples a lower portion of said support bracket to a lower portion of said beam, a tilt cylinder which couples an upper portion of said support bracket to an upper portion of said beam, and a lift cylinder which couples an upper portion of said support bracket to a lower portion of said beam, the improvement comprising a pair of link members pivotally supporting said shank on said beam to thereby form a quadric linkage to provide linear motion of said shank when said hydraulic breaker gives said shank a blow.

2. A direct driven type shock ripper device according to claim 1, wherein said beam is provided with a pair of link member stoppers which limit the linear motion of said shank permitted by said link members, and wherein an elastic bushing for absorbing vibrations of said shank is provided at the portion of the beam at which a respective link member is pivotally supported.

3. A direct driven type shock ripper device according to claim 1, wherein said beam is provided with a pair of upper and lower side stoppers which grip said shank and thereby receive a lateral force generated in said shank when the vehicle is swivelled.

4. A direct driven type shock ripper device according to claim 1, wherein an elastic bushing for absorbing vibrations of said hydraulic breaker is provided at a portion of said beam at which said breaker mount bracket is mounted, and wherein said breaker mount bracket is provided with an elastic bushing which prevents lateral deflection of said hydraulic breaker when said hydraulic breaker gives said shank a blow.

* * * * *